United States Patent [19]

Dorfman et al.

[11] 4,074,646

[45] Feb. 21, 1978

[54] VARIABLE FOIL KEEL AND SAIL BOAT

[76] Inventors: Jan William Dorfman, 173 Roxborough St. E.; Michael David Nisbet Carson, 39 Addington Ave.; George Angus Rolston, 140 Erskine Ave., Apt. 2804, all of Toronto, Ontario, Canada

[21] Appl. No.: 689,174

[22] Filed: May 21, 1976

[51] Int. Cl.[2] ..... B63B 3/38

[52] U.S. Cl. ..... 114/39; 114/140; 114/162

[58] Field of Search ..... 114/39, 162–164, 114/140–143, 127–139, 66.5 H, 274–282; 244/44, 219

[56] References Cited

U.S. PATENT DOCUMENTS

| | | | |
|---|---|---|---|
| 1,790,309 | 1/1931 | Kientz | 244/44 |
| 1,924,871 | 8/1933 | Ludington | 114/130 |
| 2,912,190 | 11/1959 | MacDonough | 244/44 |
| 3,505,968 | 4/1970 | Gorman | 114/39 X |
| 3,753,415 | 11/1971 | Burtis | 114/127 X |

FOREIGN PATENT DOCUMENTS

| | | | |
|---|---|---|---|
| 50,343 | 12/1940 | Netherlands | 114/162 |
| 51,251 | 3/1941 | Netherlands | 114/162 |

*Primary Examiner*—Trygve M. Blix
*Assistant Examiner*—Sherman D. Basinger

[57] ABSTRACT

A sailboat, and a variable foil appendage, ie., keel or rudder for a sailboat, the appendage having a central core portion, and movable skin portions on either side thereof, the skin portions being connected to the core portion essentially along the forward and trailing edges of the skin portions, at least one of such connections being movable, and a fluid-operated skin movement control system being provided in the core portion, operation of the control system producing outward bulging or flattening of one or other of the skin portions to form a bulged generally convex profile extending upwardly and downwardly along one side of the core portion, while the skin portion on the opposite side of the core may be bulged or flat, the control system being selectively operable thereby enabling the foil section of the appendage to be changed, as the sailboat comes about from one tack to the other.

10 Claims, 5 Drawing Figures

VARIABLE FOIL KEEL AND SAIL BOAT

The invention relates to sailboats, and in particular to a sailboat having a keel having a cross section which may be varied from one side or the other so as to vary the foil section of the keel, and further relates to variable foil appendages including keels, rudders and centerboards for sailboats.

BACKGROUND OF THE INVENTION

Sailboats usually incorporate a keel, which provides stability for the sailboat, and also prevents the sailboat from "sideslipping" in response to the force that is created by the wind.

Such a keel prevents "sideslipping" both by simply resisting lateral movement through the water, and also by providing a positive so-called "lifting" force. This is achieved by employing a keel having a foil section which is convex on both sides of the keel. Such a foil section operates somewhat in the manner of an aircraft wing, and responds to the forward movement of the sailboat through the water to provide a positive sideways force or lift, which in fact reacts against the sideslipping forces imposed by the wind. This effect is particularly noticeable when the sailboat is sailing with the wind ahead of the beam, i.e., when it is sailing so-called "up-wind."

Because a sailboat is sailed on either tack it is essential that the keel be capable of producing lift both on one side and the other and consequently it is given a convex shape or foil section on both sides.

It is however well known that the shaping of the keel with a foil section which is symetrically convex on both sides severely restricts the ability of the keel to provide lift on one side, without producing lift on the other side as well. In fact, it is fairly well established that the keel will produce lift only when the sailboat is moving both in a forward direction, i.e., along an axis running from the stem of the stern of the sailboat and is also moving slightly in a sideways direction as well so that the resultant actual track of the sailboat is at an angle of between 4° and 8° to its longitudinal axis. The precise reasons why this occurs are not entirely understood, but it is believed to be due to the fact that when moving in this slightly offset or diagonal manner, the water moves past the keel in a different manner on the respective windward and leeward sides of the keel, and that this difference produces a negative pressure on the windward side of the keel thereby producing lift, similar to the effect of an aircraft wing.

Clearly, however, the analogy between a keel which is convex on both sides, and an aircraft wing which is convex on the upper side and either concave or flattened on the under side is of only relatively limited assistance in explaining the function of the keel as the boat moves through the water.

It is however widely believed that if a keel could be made with a foil section like a wing, i.e., more or less flat on the leeward side of the boat, and convex on the windward side of the boat, then it would produce very much more lift, and would tend to cause the sailboat to follow a track which more closely approximated to the fore and aft axis of the boat, and did not produce so much sideslipping. However, there are a number of factors which in the past have prevented this. Clearly, such a result could be achieved by the use of two keels, one of which could be drawn upwardly into the boat while sailing in one direction and then lowered down again, while the other one was raised upwardly for sailing in the other direction. Indeed, there have in the past been proposals somewhat of this nature.

Another proposal has been the use of so-called "leeboards" or "bilgeboards." These are a form of boards, like a keel, which are in fact attached to the two sides of the boat, and are lowered down and raised up alternately as the boat moves from one tack to the other. Such leeboards have been proposed which are convex on one side and flat on the other. However, leeboards have not achieved any wide popularity in use, and introduced various other inefficiencies in hull design which more than offset the advantages gained by using improved foil sections.

The same design considerations apply to some extent to rudders for sailboats, which at present are usually made with a symetrically convex foil section on both sides, and also to movable keels known as centerboards.

BRIEF SUMMARY OF THE INVENTION

The invention therefore seeks to provide, a sailboat, and a variable foil appendage, i.e., keel or rudder for a sailboat, which overcomes the foregoing disadvantages, by the provision of a sailboat having a hull, and an appendage located therebeneath, said appendage having a central core portion, and movable skin portions on either side thereof, the skin portions being connected to the core portion essentially along the forward and trailing edges of the skin portions, at least one of such connections being movable, and skin movement means being provided on the core portion, and movable outwardly to one side or other of the core portion, the movement means being located between each of the skin portions, operation of the movement means producing outward bulging of one or other of the skin portions to form a bulged generally convex profile extending upwardly and downwardly along one side of the core portion, while the skin portion on the opposite side of the core may be bulged or flat, the movement means being selectively operable to bulge the skin portion on both or on one side, and permit the other side to become flattened out, thereby enabling the foil section of the appendage to be changed, as the sailboat comes about from one tack to the other.

More particularly, it is an objective of the invention to provide a sailboat having a variable foil appendage in which the skin portions are arranged so that one edge of each skin position is attached in fixed relation along the one edge of the appendage, and the opposite edge of each skin portion being movably connected to the other edge of the appendage, a bulging of one or other of the foil section thereby procuring movement of the movable edge of the foil section relative to the appendage.

More particularly, it is an objective of the invention to provide a sailboat having a variable foil appendage having the advantages described above, in which the power operated means may be hydraulic or, pneumatic, or a combination of any one or other of these forms of movements.

It is a further and related objective of the invention to provide components for the manufacture of a variable foil keel including a leading edge section for attachment to a keel on an existing sailboat, such leading edge section incorporating attachment means for attachment of the leading edge of the skin portions thereto on either side of the keel, and further including a trailing edge section for attachment to the trailing edge of the keel, said section incorporating movable connection means for connection of at least one edge of the skin portions along an edge of the keel, and said system further incorporating power operated means adapted to be installed in the core of the keel itself, and being extendable outwardly selectively on one side or the other of the core portion for bulging of the skin portions.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF A SPECIFIC EMBODIMENT

Figure 1:
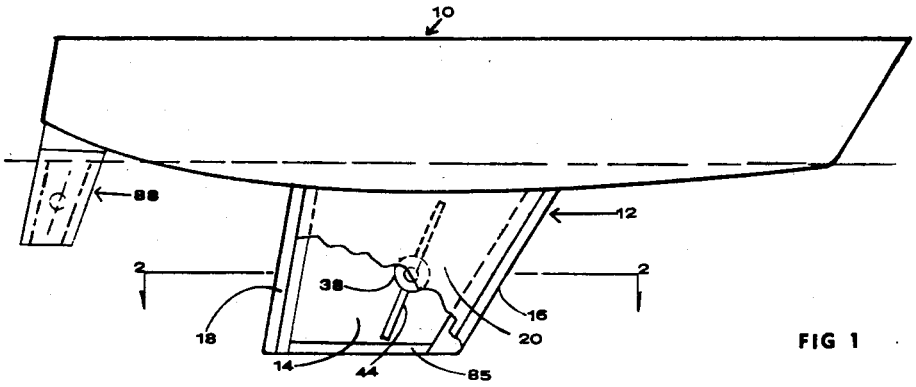
FIG. 1 is a side elevational view of a sailboat hull shown with a keel and a rudder incorporating the variable foil section according to the invention.
Figure 2:
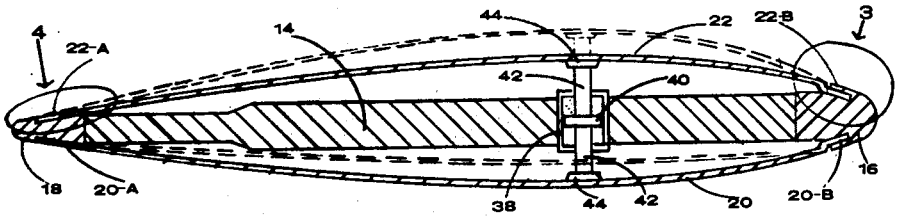
FIG. 2 is a section along the line 2—2 of FIG. 1 showing one side of the keel bulged outwardly.

Referring, first of all, to FIGS. 1 and 2, it will be seen that this preferred embodiment of the invention comprises a sailboat hull 10 having a keel indicated by the general reference arrow 12. The keel 12 will be seen to comprise a central core portion 14. The core portion 14 will be a rigid member, of predetermined thickness, and the thickness may in fact vary making the core somewhat slimmer at the lower end and somewhat fatter at the upper end close to where it joins the hull. The shaping of the overall keel 12 will to a large extent be dependent upon the particular hull design. However, neither the keel 12 nor core 14 need be the same thickness throughout its height.

At the leading edge of the core portion 14 a leading edge section 16 is provided, and at the trailing edge of the core portion a trailing edge section 18 is provided. The leading and trailing edge sections may be formed separately from the forming of the core portion 14 itself. They may for example be castings of any suitable alloy, so that they may be designed to fit the shaping and design of the keel of any particular boat. However, where a large number of the same boats are manufactured according to the same design, then conceivably they may be produced in some other way by some more economical method.

Extending between the sections 16 and 18, on either side of the core portion, there are provided movable outer skin portions 20 and 22. The outer skin portions 20 and 22 have a depth and width equal to slightly less than that of the core portion, and leading and trailing edge sections. The trailing edges 20*a* and 22*a* of the skin portions 20 and 22 are attached down either side of the trailing edge section 18. Preferably, the trailing edge section 18 will be provided with suitably recessed portions 24 (see FIG. 4) down either side thereof, having a depth equal to about the thickness of the flexible skin portions, and screws 26 or the like may be used at intervals for attachment of the flexible skin portions thereto to make a smooth faired finish.

Figure 3:
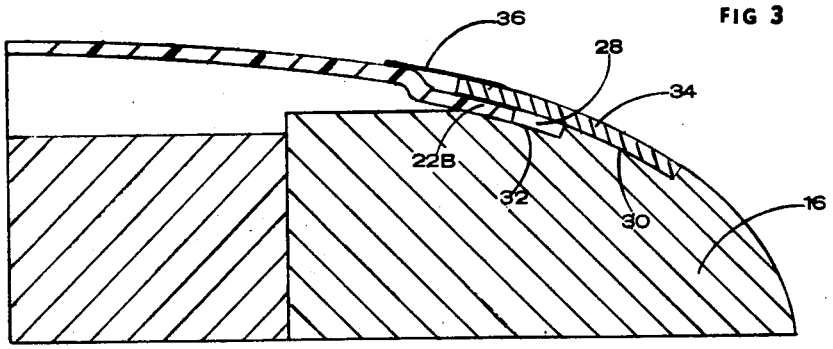
FIG. 3 is an enlarged section showing a detail of the construction of FIG. 2 circled at "3"
Figure 5:
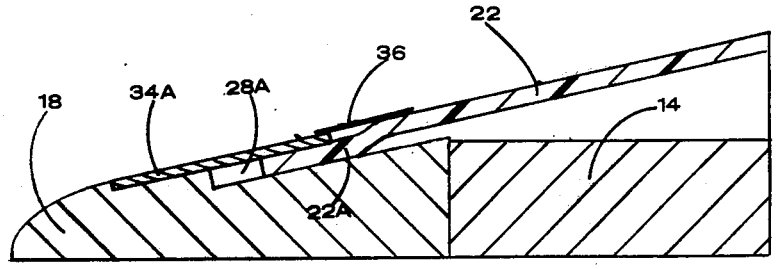
FIG. 5 is a section similar to FIG. 4 showing an alternate embodiment.

The leading edge section 16 is formed with relatively deep longitudinal grooves or slots 28 (FIG. 3). The grooves or slots 28 receive therewithin the leading edges 20*b* and 22*b* of the flexible skin portions 20 and 22.

The flexible skin portions 20 and 22 are themselves in this preferred embodiment of the invention made of glass reinforced plastic, or thin flexible sheet metal for example, stainless steel aluminum alloy or the like. Such sheets, e.g., of stainless steel will adopt a normally flat position lying against the sides of the core portion.

The slots 28 in section 16 are preferably formed by casting two steps or ledges 30 and 32 along either side of the section 16. Longitudinal plates 34 are fastened to the ledges or recesses 30 by screws or the like and extend over the ledges or recesses 32 thereby forming deep narrow slot 28.

However, such slots could be formed by casting them into the section 16 if desired.

Preferably the leading edges 20*b* – 22*b* of the skin members 20 – 22 are offset as shown so as to make a smooth faired finish. An additional fairing strip 36 can be attached to the plates 34 extending over the skin members 20 – 22. Such fairing strips will be made of semi-stiff plastic, e.g., Nylon (trade mark) or other suitable thin material.

In order to bulge one or other of the skin portions outwardly, any suitable mechanical or power operated means may be provided for the purpose. In this preferred embodiment of the invention, the power operated means is illustrated in the form of a hydraulic cylinder 38, having a double acting piston 40 therein which may be moved either one way or the other by the selected application of suitable valve means and pumping means (not shown) such as are well known in the hydraulic cylinder art.

Extending outwardly from the double acting piston 40 there is provided two piston rods 42. Extending outwardly and downwardly from each of the piston rods 42 are spreader bars 44. The spreader bars 44 lie along a generally central upright axis or median of each of the flexible skin portions 20 and 22. Operation of the piston in either direction will push the appropriate bar outwardly thereby bulging the center of the respective skin portion 20 or 22 outwardly with respect to the core portion 14 of the keel. The outer skin portion 20 or 22, on the other side of the core portion 14, will of course remain contracted, lying close to, or against the core portion. If desired suitable vertical recesses can be provided in the core portion for receiving the vertical bars when they are in their inactive position.

Thus, the desired objective of the invention, namely, to provide a keel which is more bulged on one side and flattened, or less bulged on the other are provided by this means.

Clearly, as the sailboat tacks from one tack to the other, the power operated means may be operated so as to retract the bulged side of the keel to make it flatter and simultaneously bulge the other side.

As shown in FIG. 3, the bulging of skin portion 22 will cause the edge 22*b* to slide partially out of groove 28 and the skin portion 22 can thus adopt a smoothly curved convex section. The edge 20*b* of the other skin portion 20 will remain in its groove 28, with a flatter contour, which may be entirely flat, or simply less curved than skin portion 22.

Figure 4:
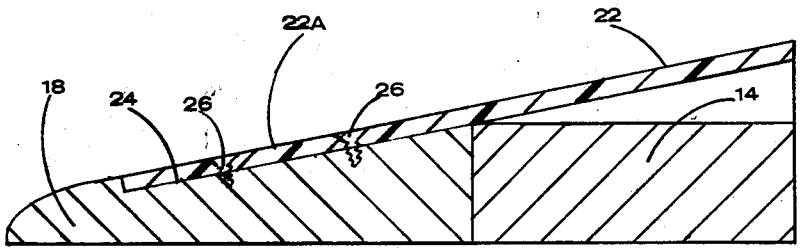
FIG. 4 is an enlarged section showing a detail of FIG. 2 circled at "4"

Alternatively the skin panels 20 and 22 can be fixedly attached to the leading edge 16 and movably connected along trailing edge 18, as shown in FIG. 4, the features of the ledge and strip being identified by the suffix "*a*" and the same numbers.

If it is desired to provide the keel with a foil section which is equally bulged on either side, then the piston can simply be operated until it is central with respect to the cylinder, at which point each of the flexible skin portions will then be equally extended on either side to about half of its total available extension.

In order to prevent undue turbulence at the upper and lower edges of each of the skin portions, there may, if desired, be provided lower ledges formed along the lower ballast 85 attached to the core 14 (FIG. 1). Obviously, the precise shaping of such ledge strip would be dependent upon various design considerations arising out of the design of the hull of the particular sailboat.

However, the upwardly directed surfaces of such ledges will be essentially flat so that the lower edge of the skin portion can move outwardly and inwardly without obstruction.

Similarly, additional extension portions will be attached alongside the core portion where the same meets the hull for the same purposes.

Alternatively, in a more complex design, possibly in a larger hull, it may be desirable to provide for fairing portions (not shown) which are actually attached to the skin portions themselves and may be drawn outwardly and retracted again as the skin portions move outwardly and inwardly, in practice however, it is believed that such additional features would not normally be necessary.

The same skin panels and operating means may be employed on the rudder 88 of hull 10, the details of which will be essentially similar. Also a centerboard can be provided with such movable skin panels in the same manner as described above, if desired.

The foregoing is a description of a preferred embodiment of the invention which is given here by way of example only. The invention is not to be taken as limited to any of the specific features as described but comprehends all such variations thereof as come within the scope of the appended claims.

What is claimed is:

1. A sailboat of the type having a hull and at least one underwater appendage, said appendage comprising:

a core portion, attached to said hull;

flexible skin portions attached on either side of said core portion, and being movable between a generally retracted inward position alongside said core, and an extended outwardly bulged position, the maximum extension of said skin portion extending along an axis lying in a generally upward and downward direction intermediate the fore and aft edges of the core, whereby to provide an appendage having a horizontal cross-section which may be outwardly bulged on one side and flatter on the other side;

a cylinder, a fluid medium adapted to be pumped into and released from said cylinder, a piston within said cylinder, two operating rods connected with said piston, extending from said cylinder on opposite sides of said core, said cylinder being located in said core, and said operating rods communicating with respective said skin portions on opposite sides of said core portion whereby said skin portions may be selectively bulged outwardly from the core portion and retracted inwardly towards the core portion.

2. A sailboat as claimed in claim 1 wherein said flexible portions are attached along one edge to an adjacent edge of said core portion, and wherein another said edge of said flexible portion is movably connected adjacent another said edge of said core portion, whereby to permit extension and retraction of said skin portions as aforesaid.

3. A sailboat as claimed in claim 2 wherein said flexible skin portions are attached along a leading edge thereof to a leading edge of said core portion, and wherein the trailing edge of said flexible skin portions are movably connected to the trailing edge of said core portion.

4. A sailboat as claimed in claim 2 wherein said trailing edges of said flexible portions are attached along the trailing edges of said core portion, and wherein the leading edges of said flexible portions are movably connected along the leading edge of said core portion.

5. A sailboat as claimed in claim 2 wherein said movably connected edges of said skin portions are movably connected by means of slotted recess means located along either side of said edge of said core portion, said movably connected edges of said flexible skin portions being slidably received in said slotted recess means, for sliding movement relative to said core portion.

6. A sailboat as claimed in claim 5 including edge portions formed along said movably connected edges of said flexible skin portions, said edge portions being inwardly offset with respect to the rest of said flexible skin portions whereby to fit within said slotted recess means.

7. A sailboat as claimed in claim 6 including flexible fairing means extending over the junction between said edge portions of said skin portions, and said slotted recess whereby to reduce drag.

8. A sailboat as claimed in claim 1 including spreader bar means located on the inwardly directed sides of said flexible skin portions intermediate said fore and aft edges, and operatively connected with said rod means whereby to procure uniform bulging of respective skin portions as aforesaid.

9. A sailboat as claimed in claim 1 wherein said core portion is a portion of the keel of a sailboat hull, and said flexible skin portions are located on either side of said core portion whereby to provide a keel which may be bulged outwardly on one side, and retracted into a flatter position on the other side, whereby to provide a keel having a variable foil section.

10. A sailboat as claimed in claim 1 wherein said core portion forms a portion of the rudder therefor, and wherein said flexible skin portions are attached along either side of said core portion as part of said rudder, whereby to provide a rudder which may be outwardly bulged on one side and flattened on the other, whereby to provide variable foil section.

* * * * *